United States Patent [19]

Hite

[11] Patent Number: 5,000,073

[45] Date of Patent: Mar. 19, 1991

[54] CONSTRUCTION FOR SUPPORTING A REED UPON THE MOUTHPIECE OF A MUSICAL WIND INSTRUMENT AND METHOD OF FABRICATING THE SAME

[76] Inventor: David L. Hite, 17133 Haitian Dr., Fort Myers, Fla. 33912

[21] Appl. No.: 481,281

[22] Filed: Feb. 20, 1990

[51] Int. Cl.[5] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 2,292,584 | 8/1942 | Tafarella | 84/383 B |
| 3,205,753 | 9/1965 | Luyben | 84/383 B |
| 3,433,113 | 3/1969 | Portnoy | 84/383 B |
| 4,275,636 | 6/1981 | Van Doren | 84/383 B |
| 4,428,271 | 1/1984 | Winslow et al. | 84/383 B |

*Primary Examiner*—Lawrence R. Franklin

*Attorney, Agent, or Firm*—Pearne, Gordon, McCoy & Granger

[57] ABSTRACT

A ligature for supporting a reed upon the mouthpiece of a single reed musical wind instrument, and method of fabricating the same. The substrate is stamped and formed into a generally tubular, longitudinally split clamping band that has two diametrically opposed windows cut therein. The end portions of the substrate are brought into abutting relation, and a pair of tubular barrels having an inner bore are braised to the exterior surface of the substrate adjacent the edges of the abutting end portions. The inner bore of each barrel has a threaded end portion. The barrels are each cut through their center portion. Each barrel is adapted to cooperate with a thumb screw to adjustably move the end portions of the substrate relative to each other so the ligature can be tightly secured upon the mouthpiece. A pair of longitudinally spaced clamping surfaces are formed in the end portions of the substrate extending inwardly and radially opposite the barrels. Each clamping surface includes a cushion disposed on each end portion having a contoured surface that conforms to the radius of curvature of the reed when supported upon the mouthpiece. The cushions contact the reed at the reed's nodal points. Two pair of substantially circumferential ribs extending radially inwardly from the inner surface of the substrate are formed, one pair of ribs circumferentially aligned with one clamping surface, and the other pair of ribs circumferentially aligned with the other clamping surface.

10 Claims, 3 Drawing Sheets

Fig.1

CONSTRUCTION FOR SUPPORTING A REED UPON THE MOUTHPIECE OF A MUSICAL WIND INSTRUMENT AND METHOD OF FABRICATING THE SAME

BACKGROUND OF THE INVENTION

1. Field of the Invention

This invention relates to devices for supporting reeds upon the mouthpiece of musical instruments, and in particular to a ligature for supporting a reed upon the mouthpiece of a single-reed musical wind instrument, and a method of fabricating the same.

2. Description of the Prior Art

A considerable variety of musical wind instruments require the use of a ligature, or reed-supporter, to secure a single reed to the mouthpiece of the instrument. There is a vibrational cooperation between the mouthpiece, reed, and ligature when the instrument is played that directly affects the quality of the sound achieved. This cooperation is well known in the art, and various approaches have been implemented to attain the finest sound.

When a reed is supported upon the mouthpiece of a single-reed instrument, the ligature must contact both the reed and the mouthpiece in order to properly secure the reed to the mouthpiece. The areas of contact between the ligature and the reed, and between the ligature and the mouthpiece affect the vibrational cooperation of the assembly.

A typical mouthpiece used with a single reed wind instrument has a tapered, generally round body with an exposed open end upper section, and an exposed closed end lower section flattened to form a table upon which the reed is supported. A typical reed has a relatively flat upper surface, which contacts the table of the mouthpiece, and a curved lower surface which is contacted by the ligature. The mouthpiece is substantially hollow and acts as a resonance chamber when the instrument is played.

Several common goals are pursued by the interaction of a reed, a mouthpiece, and one of the various ligatures available on the market today. An instrumentalist is desirous of having the reed quickly respond when attacked thereby providing necessary flexibility and control of the instrument. Full, dark, rich, and mellow tonal qualities are sought. Enhancement of the overall performance of an instrument is of paramount concern.

The ultimate goal is superior performance of an instrument as determined by the subjective analysis of the individual instrumentalist playing a particular instrument. Subjective satisfaction instills a great deal of confidence in instrumentalists thereby allowing them to perform at their pinnacle.

Most prior art ligatures primarily focused on the vibration enhancement of the reed, or the mouthpiece. U.S. Pat. No. 4,080,866 issued to Toof on Mar. 28, 1978 discloses a ligature that supports a reed upon a mouthpiece by applying pressure at two points along the longitudinal center portion of the reed. Toof provides a pair of longitudinally spaced rigid bars transverse to the reed that create two points of contact upon the apex of the curved lower surface of the reed. The points of contact being along the longitudinal center portion of the reed allows the lateral portions of the reed to vibrate. The substrate, or clamping band portion, of the ligature remains flush against the mouthpiece.

One primary goal of ligature design is to provide more freedom of vibration for a single reed when supported upon a mouthpiece. U.S. Pat. No. 3,410,170 issued to Gigliotti on Nov. 12, 1968 discloses a ligature provided with longitudinal non-damping spacers depending from the inner surface of the ligature. The spacers hold the main portion of the ligature out of direct contact with the body of the mouthpiece, and contact is effected only at the areas under the spacers. The surface area of each spacer contacting the mouthpiece is relatively wide. Gigliotti found that the use of the spacers resulted in greater vibration in the mouthpiece than was found without their use thereby enhancing the desirability of the musical instrument as a whole. Furthermore, Gigliotti provides three buttons along each side of the ligature's longitudinal split that secure the reed to the mouthpiece. The buttons are spaced longitudinally and contact the reed along its mid-apex regions. The theory being to provide the least amount of contact between the ligature and the reed at these specific points, thereby allowing the reed more freedom of vibration.

Another prior art ligature is disclosed in U.S. Pat. No. 3,618,440 issued to Ratterree on Nov. 9, 1971. The approach of Ratterree is to provide a ligature constructed from a relatively narrow band that allows more freedom of vibration in the mouthpiece rather than the reed. The ligature is provided with four inwardly directed longitudinal flanges that space the ligature substrate from the mouthpiece. Two of the flanges make a relatively wide surface contact with the mouthpiece, while the other two make a relatively narrow line of contact. A pair of flanges depend from the interior surface of the substrate and contact the reed near its mid-apex regions to support it upon the mouthpiece.

U.S. Pat. No. 3,433,113 issued to Portnoy on Mar. 18, 1969, the disclosure of which is hereby specifically incorporated by reference, discloses a ligature designed to allow a maximum amount of the heel portion of the reed to vibrate simultaneously with the upper or tapered end of the reed. This is accomplished by four small reed-holding lugs positioned on the curved top central portion of the heel of the reed. The lugs are longitudinally spaced and contact the reed close to its apex region. This positioning allows the sides of the heel, and the intermediate portion of the heel across its entire width to more fully vibrate together. The lugs make relatively small surface contact with the reed and are longitudinally connected by elevated cross-bar-supports that create more rigidity in the ligature.

It is recognized that the ability of the ligature to vibrate sympathetically with the reed contributes significantly to the overall performance of a wind instrument. Suspending the substrate, or clamping band portion, of the ligature away from the mouthpiece not only facilitates vibration of the mouthpiece, but also enhances the ligature's ability to vibrate sympathetically with the reed, which consequently enhances the reed's vibration.

SUMMARY OF THE INVENTION

It has been discovered that when the reed is contacted in specific regions by the ligature bed, which is that portion of the ligature directly contacting the reed, the reed cooperates in a superior manner with the ligature. These regions are referred to as nodal points. When a reed is supported at its nodal points, the reed achieves more freedom of vibration. Moreover, the type of contact between the ligature bed and the reed affects the ligature's ability to vibrate sympathetically with the reed.

Accordingly, it is an object of the preferred embodiment of the present invention to provide a ligature having means for suspending the clamping band portion of the ligature above the mouthpiece of a wind instrument in a manner that facilitates the ligature's ability to sympathetically vibrate with the reed, thereby supplementing resonance of a generated tone.

It is a further object to provide a ligature bed having contact means for supporting the reed at its nodal points upon the mouthpiece, the contact means creating a superior vibration transfer capability between the reed and the ligature than has been previously obtained, thereby enhancing the reed's overall performance.

The preferred embodiment of the present invention provides a ligature having a generally tubular, longitudinally split substrate, or clamping band, that encircles the mouthpiece of a wind instrument. A pair of tubular barrels are transversely mounted upon the exterior surface of the clamping band near the longitudinal split. Each barrel is adapted to cooperate with a thumb screw so the end portions of the clamping band can be adjusted relative to each other to secure the ligature to the mouthpiece.

When the ligature is fabricated, the tubular barrels are braised tangentially to the exterior surface of the clamping band so that their midpoint coincides with the longitudinal split. Each barrel is cut through at its midportion. The clamping band is placed into an appropriate die and pressure is exerted upon the end portions of the clamping band. Thus, two pair of longitudinally spaced, recessed clamping cushions are coined on the interior surface of the end portions of the clamping band. Each cushion has a contoured surface that conforms to the curved surface of the reed when supported.

The cushions support the reed at the reed's nodal points when the reed is properly situated upon the table of the mouthpiece. Supporting the reed at these points allows the reed's longitudinal apex region, and intermediate region across its entire width to vibrate more fully. Thus, vibration of the entire reed is enhanced which provides superior overall performance of the wind instrument.

Two pairs of substantially circumferential ribs suspend the clamping band away from the mouthpiece when the reed is supported thereon. Each pair of ribs is circumferentially aligned with one of the pairs of clamping cushions. Suspending the clamping band in this manner allows it to vibrate sympathetically with the reed.

It has been discovered that the area contact between the contoured surface of each cushion and the reed provides a superior transfer of vibration between the ligature and the reed than has been previously obtained. The ligature vibrates sympathetically with the reed through these cushions thereby giving the reed more vibrancy, more life, more response, more volume, and a smoother quality in the extreme high, or third, register. Specifically, the third register is considered a problem register for the clarinet because it is difficult to keep the clarinet from sounding too bright and too shrill. The effect of the preferred embodiment is to mellow the clarinet in the third register and give it a smooth velvety quality rather than a stridency that it otherwise would have. In the middle range it seems to enhance the middle partials that give richness to the sound, rather than enhancing the extreme high partials which gives thinness and brightness to the sound.

Furthermore, when initiating the sound of the reed, what is known as the attack, the reed begins its vibrations much cleaner, with less struggle, and with less effort to start a phrase or a delicate note. It has been discovered that in these extreme areas of refinement the preferred embodiment of the present invention seems to give a great deal of satisfaction that other ligatures do not.

Additionally, the ligature is coated with a plating of silver that contributes to the body of the sound achieved from the wind instrument.

Many factors, both human and structural, are associated with the overall performance of a musical wind instrument. Pertaining to ligatures, their effectiveness does not lend itself to a quantitative analysis, but rather it is determined by the subjective analysis of the individual instrumentalist. The preferred embodiment's effectiveness in enhancing the overall performance of musical wind instruments is demonstrated by its acceptance among many members of the musical community.

DETAILED DESCRIPTION OF THE PREFERRED EMBODIMENT

Figure 1:
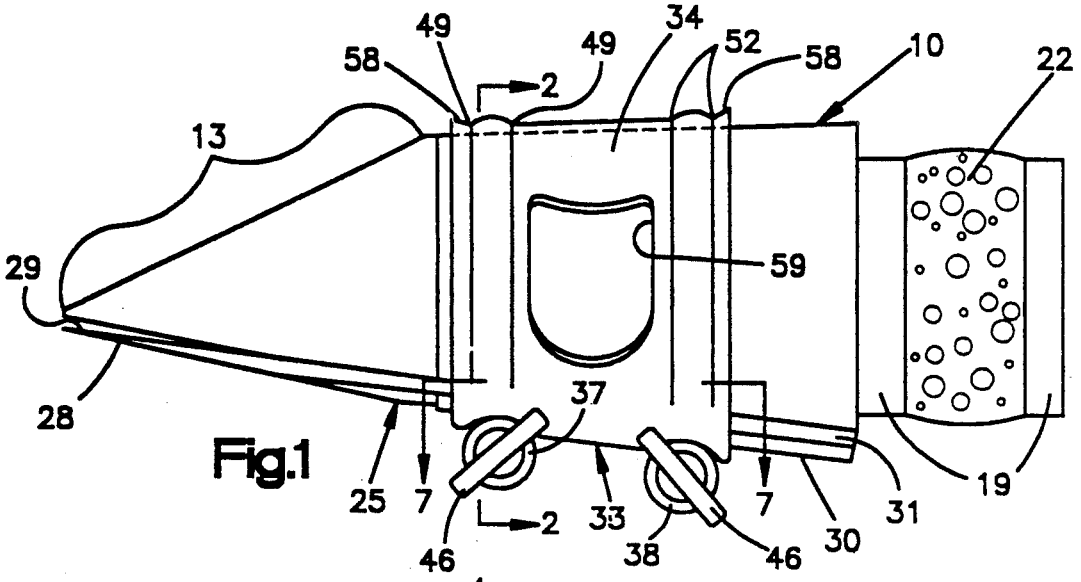
FIG. 1 is a side elevational view of a reed supported upon a mouthpiece according to a preferred embodiment of the present invention.
Figure 2:
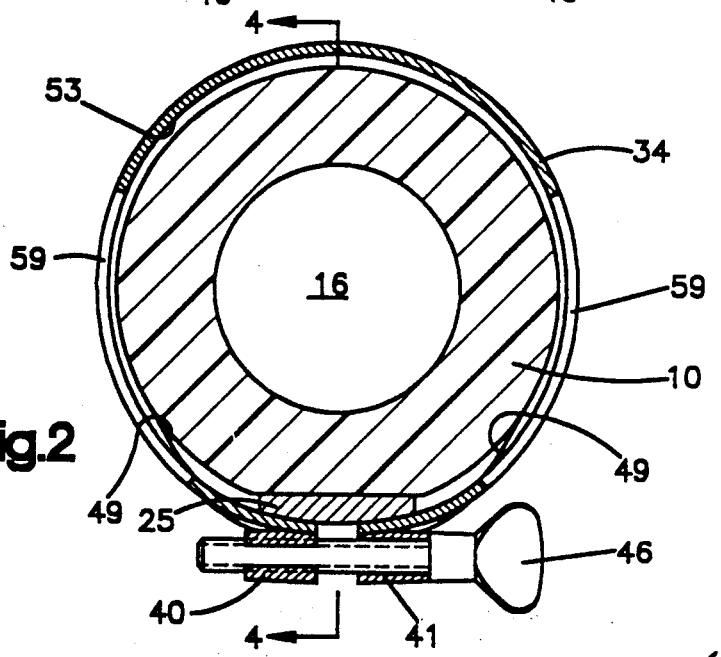
FIG. 2 is a cross-sectional end view taken along line 2—2 of FIG. 1.
Figure 3:
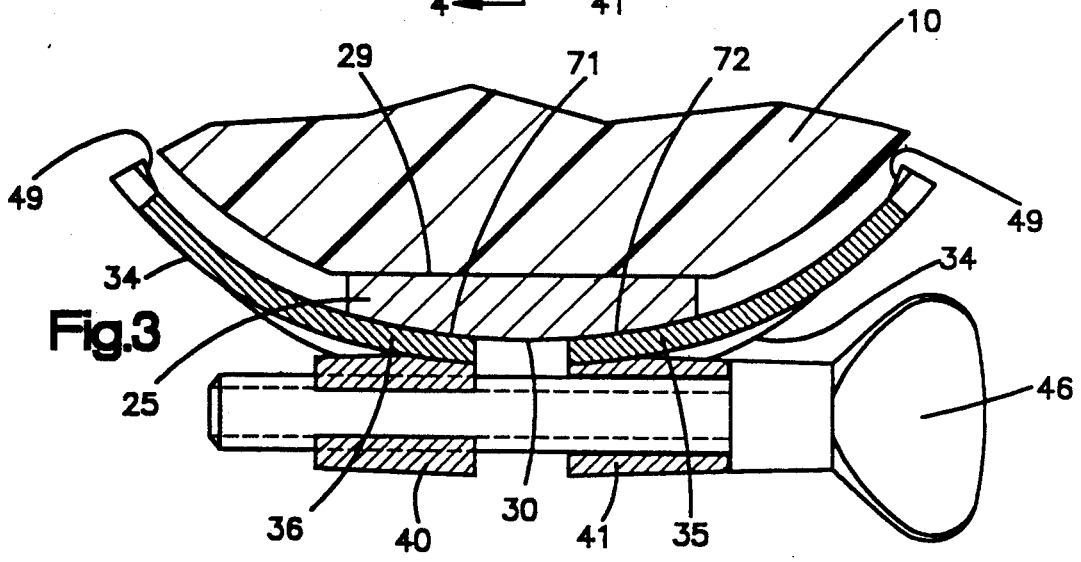
FIG. 3 is a fragmented view of FIG. 2, shown to a larger scale.
Figure 7:
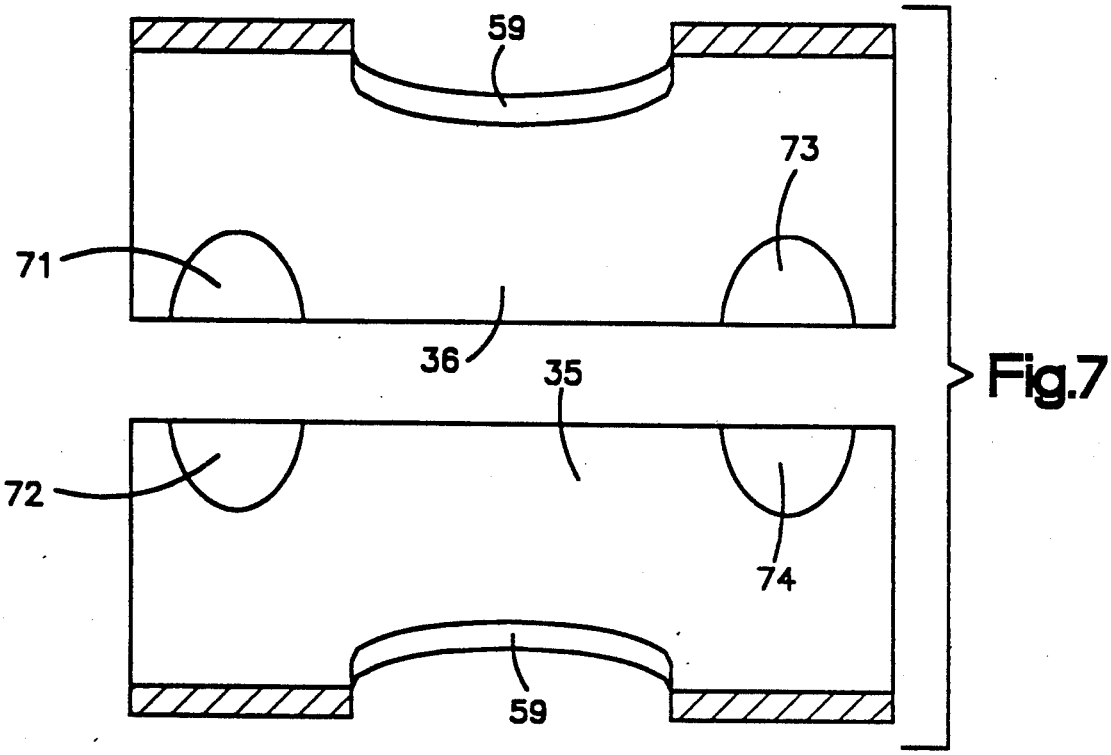
FIG. 7 is a cross-sectional view taken along line 7—7 of FIG. 1, shown to a larger scale.
Figure 6:
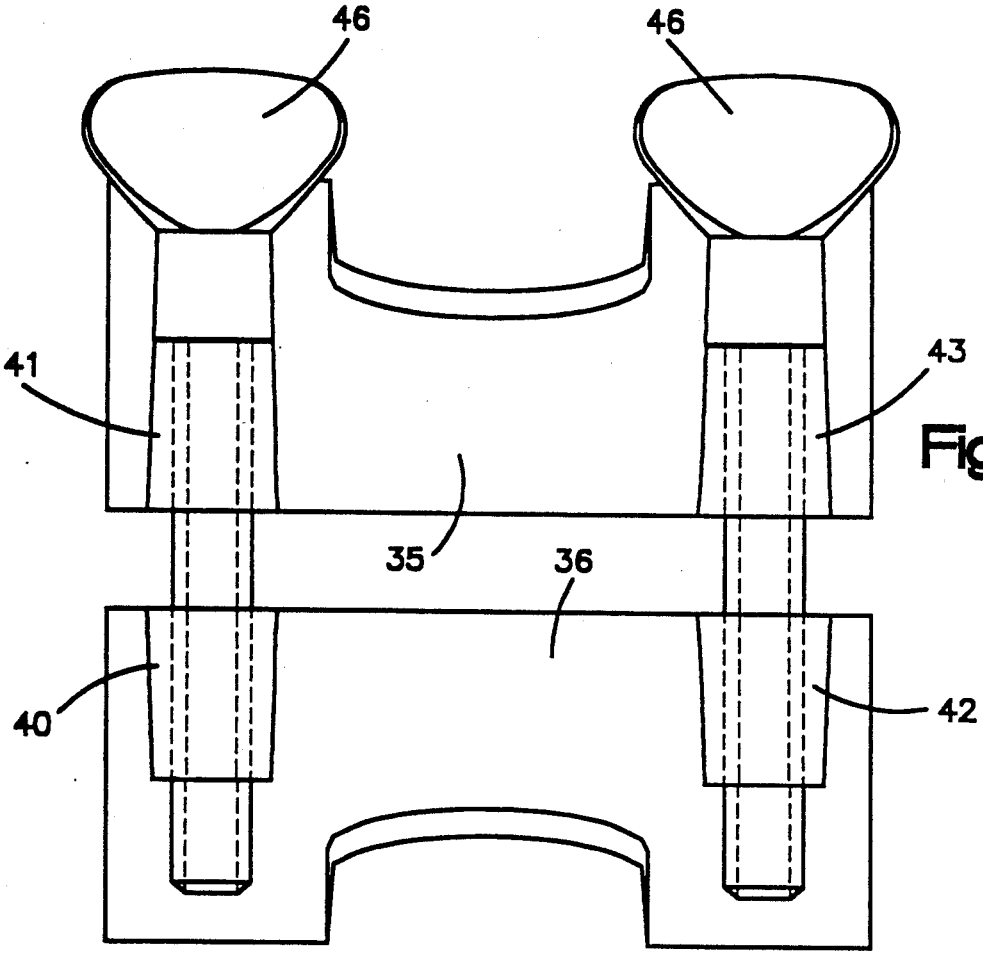
FIG. 6 is a partial bottom view of the preferred embodiment of FIG. 1, shown to a larger scale.

Referring now to the drawings, and in particular to FIGS. 1–3, there is shown a conventional mouthpiece 10 having a beak 13, a bore 16, a tenon joint 19, and a cork gasket 22. The mouthpiece 10 cooperates in a customary manner with a musical wind instrument. Supported upon the mouthpiece 10 is a conventional reed 25 having a tip 28, a relatively flat upper surface 29, a convex surface 30 that defines a transverse radius of curvature, and a heel 31. The reed 25 is supported upon the mouthpiece 10 by a ligature 33. The ligature 33 includes a clamping band 34 having a longitudinal split that forms two end portions 35 and 36, as best shown in FIGS. 6 and 7. The clamping band 34 encircles the mouthpiece 10 when the reed 25 is supported thereon by the ligature 33.

Referring to FIG. 1, the clamping band 34 has preferably braised thereto an upper tubular barrel 37 and a lower tubular barrel 38. The upper barrel 37 includes a threaded standard 40, and a smooth bore standard 41. The lower barrel 38 includes a threaded standard 42, and a smooth bore standard 43, as best shown in FIG. 6. Each barrel 37 and 38 is adapted to cooperate with a thumb screw 46 so that the end portions 35 and 36 can be adjusted relative to one another thereby allowing the ligature 33 to be tightly secured to the mouthpiece 10.

Preferably, the clamping band 34 includes two substantially circumferential upper ribs 49, and two substantially circumferential lower ribs 52. The upper ribs 49, and the lower ribs 52 extend radially inwardly from the interior surface 53 of the clamping band 34. The upper ribs 49 are substantially parallel to each other, and the lower ribs 52 are substantially parallel to each other.

Figure 4:
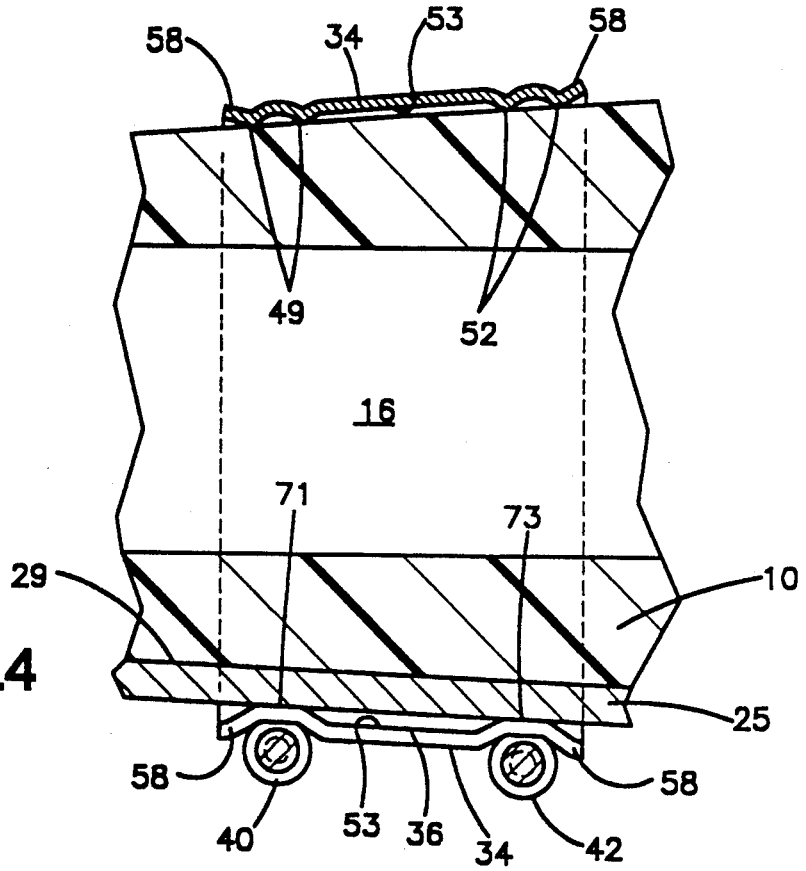
FIG. 4 is cross-sectional side view taken along line 4—4 of FIG. 2.

The upper pair of ribs 49 are preferably circumferentially aligned with the upper barrel 37, and the lower pair of ribs 52 are preferably circumferentially aligned with the lower barrel 38. Referring to FIG. 4, the ribs 49 and 52 space the interior surface 53 of the clamping band 34 away from the mouthpiece 10 when the ligature 33 is secured thereto. The ribs 49 and 52 make a relatively thin line of contact with the mouthpiece 10.

The clamping band 34 includes flange portions 58 that are flared outwardly so they don't contact the mouthpiece 10. Two diametrically opposed apertures 59 are formed in the clamping band 34, one of which is best shown in FIG. 1.

The first step of the method of fabricating the ligature 33 is to form the split clamping band 34 of a suitably stamped sheet metal into a generally tubular shape having separable end portions 35 and 36. The sheet metal is preferably brass having a thickness of about 0.016 inches.

Figure 5:
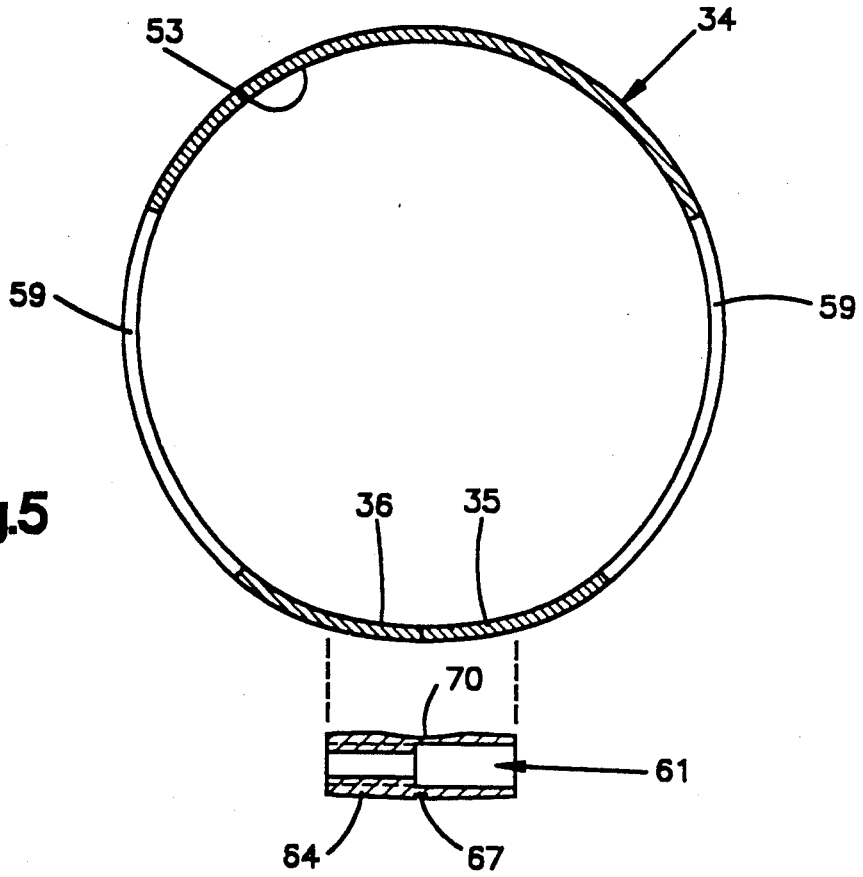
FIG. 5 is a cross-sectional end view of the clamping band portion and one tubular barrel of the preferred embodiment of FIG. 1.

Referring to FIG. 5, one tubular barrel is shown to illustrate the configuration of each tubular barrel 37 and 38. The second step is to form the tubular barrels 37 and 38, each having an inner bore 61 that is threaded in one end 64. When formed, each tubular barrel 37 and 38 is one piece having a groove 67 formed therein to facilitate cutting each barrel in two pieces. The tubular barrels 37 and 38 are preferably formed of a brass substantially similar to that of the split clamping band 34.

Step three is to form, in any suitable manner, an arcuate recess 70 in the mid-portion of the outer surface of each barrel 37 and 38. The recess 70 has a longitudinal curvature conforming to the transverse radius of curvature of the lower surface 30 of the reed 25 when the reed 25 is supported upon the mouthpiece 10.

The fourth step is to, preferably, tangentially braise the barrels 37 and 38 in a transverse manner to the exterior surface of the clamping band 34 while the end portions 35 and 36 are held in abutting relation. Alternatively, the barrels 37 and 38 could be connected to the clamping band 34 in any suitable manner. The clamping band 34 is annular when the end portions 35 and 36 abut. The midpoint of each arcuate recess 70 substantially coincides with the abutting edges of the end portions 35 and 36. Step five is cutting each barrel 37 and 38 through at the mid-portion creating the threaded standards 40, 42, and the smooth bore standards 41, 43.

Step six places the clamping band 34 in a specially contoured die to coin part of the end portions 35 and 36 inwardly in the regions radially opposite the separated standards 40, 41, 42, and 43 to form upper clamping cushions 71 and 72, and lower clamping cushions 73 and 74, as best shown in FIG. 7. After coining, the regions of the end portions 35 and 36 in the vicinity of the barrels 37 and 38 become non-annular to better conform to the reed 25, as best shown in FIG. 3.

Each clamping cushion 71, 72, 73, and 74 is preferably contoured so that its surface opposite the standards 40, 41, 42, and 43 conforms to the radius of curvature of the reed's lower surface 30 when supported upon the mouthpiece 10. The upper clamping cushions 71 and 72, and the lower clamping cushions 73 and 74 are longitudinally spaced from each other to substantially coincide with the nodal points of the reed 25.

The seventh step is to form the two pairs of substantially circumferential ribs 49 and 52 extending radially inwardly from the inner surface of the clamping band. The ribs 49 and 52 are preferably rolled in the clamping band with a special round die in a stamping press.

The brass of the ligature 33 is then polished in a suitable manner, and is plated with silver. The silver is preferably a 0.0015 inch flash of sterling silver. The ligature 33 is then treated with an oxide to achieve a grayish pewter like cast. The ligature 33 is then sprayed with a clear lacquer.

As a final step, the ligature 33 is tightly secured supporting a reed upon a mouthpiece so the ligature 33 achieves the proper shape.

While the invention has been disclosed and described with respect to a preferred embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What I claim is:

1. In a mouthpiece for a single-reed musical wind instrument, a ligature supporting a reed upon said mouthpiece, said reed having a lower surface defining a transverse radius of curvature, and a relatively flat upper surface diametrically spaced from the lower surface, said reed also having nodal points; the mouthpiece having a table upon which the reed is supported, in combination therewith the improvement wherein said ligature comprises:

a generally tubular longitudinally split clamping band having two separable end portions;

means on said end portions for adjustably securing said clamping band and said reed onto said mouthpiece;

said end portions including cushion means on the inner surface of said end portions for engaging the curved lower surface of said reed in areas extending from the opposite edges laterally inwardly toward the central portion thereof, the portions of said cushion means engaging said reed being contoured to conform to said areas, respectively; and a plurality of substantially circumferential, spaced apart, vibration transmitting ribs extending radially inwardly from the inner surface of said clamping band, said ribs contacting the outer surface of the mouthpiece when the reed is supported thereon thereby spacing said clamping band away from the mouthpiece whereby the securement of said clamping band, the engagement of said ribs with said mouthpiece, and the engagement of said cushion means with said reed areas as aforesaid serve to transfer vibration of said reed to said clamping band and permit said clamping band to vibrate sympathetically with the vibration of said reed.

2. A ligature as recited in claim 1, wherein said adjustable securing means comprises:

a pair of longitudinally spaced tubular barrels being transversely disposed upon the exterior surface of said end portions, each of said tubular barrels including a threaded standard disposed on one of said end portions, and a circumferentially aligned smooth bore standard disposed on the other of said end portions, said tubular barrels adapted to cooperate with a thumb screw thereby allowing said ligature to be securely tightened to the mouthpiece.

3. A ligature as recited in claim 2, wherein said tubular barrels are radially adjacent to said cushion means and have recesses on one side which are longitudinally curved to conform to the transverse curvature of the lower surface of said reed.

4. A ligature as recited in claim 1, wherein said cushion means comprises:

a pair of upper clamping cushions, one of said upper cushions being disposed on one of said end portions and the other of said upper cushions being disposed on the other of said end portions, each of said upper cushions including a contoured surface that conforms to the surface of the reed where the nodal points of said reed substantially exist;

a pair of lower clamping cushions, one of said lower cushions being disposed on one of said end portions and the other of said lower cushions being disposed on the other of said end portions, each of said lower cushions including a contoured surface that conforms to the surface of the reed where the nodal points of said reed substantially exist;

said upper pair of clamping cushions and said lower pair of clamping cushions being spaced longitudinally of said clamping band to coincide substantially with the nodal points of the reed when supported.

5. A ligature as recited in claim 4, wherein said plurality of ribs includes two pairs of ribs, one of said pairs of ribs being circumferentially aligned with one pair of said clamping cushions, and the other of said pairs of ribs being circumferentially aligned with the other pair of said clamping cushions, said ribs having a thin line contact with said mouthpiece.

6. A ligature as recited in claim 1, wherein said clamping band is made of brass.

7. A ligature as recited in claim 6, wherein said brass is about 0.016 inches thick.

8. A ligature as recited in claim 1, wherein said ligature further comprises a plating of oxidized sterling silver.

9. A ligature as recited in claim 8, wherein said plating of sterling silver is about 0.0015 inches thick.

10. A ligature as recited in claim 8, wherein said ligature includes a layer of clear lacquer.

* * * * *